US005816302A

United States Patent [19]

Newnes

[11] Patent Number: 5,816,302

[45] Date of Patent: Oct. 6, 1998

[54] METHOD AND APPARATUS FOR FORMING CURVED CANTS FOR CURVE SAWING IN AN ACTIVE GANGSAW

[75] Inventor: William R. Newnes, Salmon Arm, Canada

[73] Assignee: Newnes Machine Ltd., Salmon Arm, Canada

[21] Appl. No.: 826,677

[22] Filed: Apr. 7, 1997

[51] Int. Cl.[6] ..... B27C 9/00; B27C 1/00; B27B 1/00

[52] U.S. Cl. ..... 144/357; 144/3.1; 144/39; 144/369; 144/378; 144/246.1; 144/250.23; 364/474.09

[58] Field of Search ..... 364/560, 474.09; 83/74, 75.5, 367; 144/1.1, 3.1, 39, 41, 242.1, 250.23, 250.17, 356, 357, 369, 377, 378

[56] References Cited

U.S. PATENT DOCUMENTS

| | | | |
|---|---|---|---|
| 4,144,782 | 3/1979 | Lindstrum | 83/102.1 |
| 4,239,072 | 12/1980 | Merilainen | 144/357 |
| 4,373,563 | 2/1983 | Kenyon | 144/357 |
| 4,449,557 | 5/1984 | Makela et al. | 144/357 |
| 4,548,247 | 10/1985 | Eklund | 144/357 |
| 4,572,256 | 2/1986 | Rautio | 144/39 |
| 4,599,929 | 7/1986 | Dutina | 83/821 |
| 4,633,924 | 1/1987 | Hasenwinkle et al. | 144/242 |
| 4,653,560 | 3/1987 | Wislocker et al. | 144/242 |
| 4,690,188 | 9/1987 | Hasenwinkle | 144/378 |
| 4,879,659 | 11/1989 | Bowlin et al. | 144/357 |
| 4,881,584 | 11/1989 | Wislocker et al. | 144/39 |
| 4,947,909 | 8/1990 | Stroud | 144/357 |
| 5,148,847 | 9/1992 | Knerr | 144/357 |
| 5,232,030 | 8/1993 | Knerr et al. | 144/246.1 X |
| 5,310,153 | 5/1994 | Knerr | 144/357 |
| 5,400,842 | 3/1995 | Brisson | 144/2 |
| 5,469,904 | 11/1995 | Kontiainen | 144/370 |

FOREIGN PATENT DOCUMENTS 2022857 4/1996 Canada .

*Primary Examiner*—W. Donald Bray
*Attorney, Agent, or Firm*—Antony C. Edwards

[57] ABSTRACT

A gangsaw in-feed mechanism for positioning a cant and feeding the cant generally longitudinally into a gangsaw along a feed path, wherein the cant is oriented with its planar faces generally horizontal, and wherein the in-feed mechanism has laterally opposed laterally translatable skewable chipping heads lying generally in first and second generally parallel vertical planes laterally opposed on either side of the feed path, a method for opening opposed generally vertical longitudinal faces so as to form curved longitudinal profiles on laterally opposed sides of the cant according to an optimized profile solution, so as to feed the cant into the gangsaw along a generally linear feed path for curve sawing in the gangsaw, having the steps of longitudinally translating and positioning the cant along the feed path between said chipping heads, laterally translating and simultaneously skewing the chipping heads, according to the optimized profile solution, into cutting engagement with the laterally opposed sides of the cant so as to open the opposed generally vertical longitudinal faces and form the curved longitudinal profiles by aligning the chipping heads so as to align the first and second planes at an angle of attack generally parallel to the instantaneous tangent of the optimized profile solution at an instantaneous location of the cutting engagement, and feeding the cant from between the chipping heads along a generally linear portion of the feedpath into the gangsaw.

13 Claims, 5 Drawing Sheets

METHOD AND APPARATUS FOR FORMING CURVED CANTS FOR CURVE SAWING IN AN ACTIVE GANGSAW

FIELD OF THE INVENTION

This invention relates to a method and a device for forming curved cants and for sawing lumber from curved or straight cants, and in particular relates to a cant forming and feeding system, for the forming of a curved four sided cant, from a two sided cant for the breakdown of the cant in an active curve sawing gangsaw according to an optimized profile for optimum sawing of lumber, and to a method and apparatus for removing flares from lumber.

BACKGROUND OF THE INVENTION

A canted log, or "cant", by definition has first and second opposed cut planar faces. In the prior art, cants were fed straight through a profiler or gangsaw so as to produce at least a third planar face, or multiple boards, either approximately parallel to the center line of the cant, so called split taper sawing, or approximately parallel to one side of the cant, so called full taper sawing; or at a slope somewhere between split and full taper sawing. For straight cants, using these methods for volume recovery of the lumber can be close to optimal. However, logs often have a curvature and usually a curved log will be cut to a shorter length to minimize the loss of recovery due to this curvature. Consequently, in the prior art, various curve sawing techniques have been used to overcome this problem so that longer length lumber with higher recovery may be achieved.

Curve sawing typically uses a mechanical centering system that guides a cant into a secondary break-down machine with chipping heads or saws. This centering action results in the cant following a path very closely parallel to the center line of the cant, thus resulting in split taper chipping or sawing of the cant. Cants that are curve sawn by this technique generally produce longer, wider and stronger boards than is typically possible with a straight sawing technique where the cant has significant curvature.

Curve sawing techniques have also been applied to cut parallel to a curved face of a cant, i.e. full taper sawing. See for example Kenyan, U.S. Pat. No. 4,373,563 and Lundstrom, Canadian Patent No. 2,022,857. Both the Kenyan and Lundstrom devices use mechanical means to center the cant during curve sawing and thus disparities on the surface of the cant such as scars, knots, branch stubs and the like tend to disturb the machining operation and produce a "wave" in the cant. It has also been found that full taper curve sawing techniques, because the cut follows a line approximately parallel to the convex or concave surface of the cant, can only produce lumber that mimics these surfaces, and the shape produced may be unacceptably bowed.

Thus in the prior art, so called arc-sawing was developed. See for example U.S. Pat. Nos. 5,148,847 and 5,320,153. Arc sawing was developed to saw irregular swept cants in a radial arc. The technique employs an electronic evaluation and control unit to determine the best semi-circular arc solution to machine the cant, based, in part, on the cant profile information. Arc sawing techniques solve the mechanical centering problems encountered with curve sawing but limit the recovery possible from a cant by constraining the cut solution to a radial form.

Applicant is also aware of U.S. Pat. No. 4,373,563, U.S. Pat. No. 4,572,256, U.S. Pat. No. 4,690,188, U.S. Pat. No. 4,599,929, U.S. Pat. No. 4,881,584, U.S. Pat. No. 5,320,153, U.S. Pat. No. 5,400,842 and U.S. Pat. No. 5,469,904, which are all designs that relate to the curve sawing of cants. Eklund, U.S. Pat. No. 4,548,247, teaches laterally translating chipping heads ahead of the gangsaws. Dutina, U.S. Pat. No. 4,599,929 teaches slewing and skewing of gangsaws for curve sawing.

It has been found that optimized lumber recovery is best obtained for most if not all cants if a unique cutting solution is determined for every cant. It is assumed that the cant has been faced on two opposed sides in a previous device. By first rotating the cant, so that the curved portion of the cant is turned up so that the cant is formed in the straightest line allowable, the cant may then be turned 90 degrees so that the curve is now turned on to the side and the cant is transferred with its two flat surfaces facing up and down. Then the cant is passed through a scanner for scanning. For each cant a "best" curve is determined, which in some instances is merely a straight line parallel to the center line of the cant, and in other instances a complex curve that is only vaguely related to the physical surfaces of the cant.

It is an object of the invention to produce an apparatus that can allow the use of modern disc type chipping heads in a curve sawing system by having the discs skewing as well as translating to follow the optimum profile of the cant, while producing the highest quality of chips, which in of themselves have resale value in the market, or to remove flares from lumber in advance of the lumber passing into a curve sawing active machine center such as active chipping heads and an active sawbox.

It is also an object of the present invention to improve recovery of lumber from cants and in particular irregular or crooked cants by employing a "best" curve and a unique cutting solution for each cant.

To achieve these objectives a two sided cant is positioned and accurately guided or driven through a pair of dynamic conforming opposing chipping heads, to form a four sided cant just prior to a gangsaw where the four sided cant is then curve sawn into lumber by a cluster, or clusters of saws which follow the optimized curved profile of the cant as the cant is directed into the saw clusters in a straight line.

It is another object of the present invention to provide a curve sawing system that moves the cant through the chipping heads and gangsaw linearly without changing its path so as to generally produce no unintended slabs or tailings.

It is further an object of the present invention to provide capabilities of the chipping heads to move away from the cant in the event of a large bulge or horn in the cant, to prevent unequal chipping forces from forcing the cant off its optimized path, or, as stated above, using active upstream chipping heads to remove bulges, horns or flares in the cant. In one aspect of the invention, the chipping heads would also be capable of angling into the flow and plunging back in to the cant (if the bulge was in the middle of the cant for example). This action would create a short slab that could then be easily handled after exiting the gangsaw. If the slab to be formed was excessively long so as to be difficult to handle, then the chipping head might be plunged into the slab to in effect pre-buck the slab into desired lengths.

SUMMARY OF THE INVENTION

The method and apparatus of the present invention for forming curved cants for curve sawing in an active gangsaw, is for the purpose of cutting boards from a curved, tapered or straight cant in a manner designed to optimize recovery based on measured or sensed cant shape, lumber value, operator input and mill requisites, and to remove bulges, horns or flares from a cant.

The method and apparatus consists of, first, an indexing transfer which temporarily holds the cant in a stationary position by a row of retractable duckers, or other means, for regulated release onto a sequencing transfer. The sequencing transfer then feeds the cants singly through a lateral or horizontal scanner, where the scanner reads the profile of the cant and sends the data to a decision processor. It is understood that within the scope of the present invention, the sequencing transfer and lateral scanner could be replaced with a lineal scanner.

An optimizing algorithm in the decision processor generates three dimensional models from the cant's measurements, calculates a complex "best" curve related to the intricate contours of the cant, and selects a breakdown solution including a cut description that represents the highest value combination of products which can be produced from the cant. Data is then transmitted to a programmable logic controller (PLC) that in turn sends motion control information related to the optimum breakdown solution to the various machines to control the movement of the cant and the machine segments to produce the designated gangsaw products.

Immediately following the lateral or horizontal scanner is a sequencing transfer that also includes a plurality of rows of retractable duckers and/or pin stops that hold the cant temporarily for timed queued release so as to queue up the cant for release onto the positioning apparatus. The positioning apparatus includes a chainbed (which utilizes a sharpchain) with driven overhead pressrolls which hold the cant onto the chain-bed, or alternately, a group of driven bedrolls, also with driven overhead press rolls. The positioning apparatus has a skewbar, with skewbar pins that positions the cant for the optimum feeding starting position for feeding into the chipping heads, and the subsequent or downstream gangsaw.

Upstream active chipping heads may be employed to remove bulges, horns or flares on cants prior to curve sawing. Active chipping heads may also be employed immediately upstream of a sawbox, where the chipping heads are capable of moving in and out following the curve of the cant as the cant moves lineally past the chipping heads, the cant always moving in a fixed lineal path. The chipping heads are also capable of skewing left or right of the linear path of the cant so as to maintain a optimum angle of attack (normally a small degree of toe-in) at all times as the cant moves past the chipping heads. The degree the chipping heads are adjusted is determined by the specific curvature of the cant which defines the need, as the angle of the cant will change in relation of the chipping heads to the amount of curve in the cant as the cant is fed lineally through the chipping heads. The chipping heads are thus constantly adjusting the angle of attack, thus producing a non-concave surface of the face being created by the chipping heads.

In combination to creating the third and fourth face the apparatus includes a saw cluster mounted on a splined arbor. The saw cluster and arbor are capable of at least translating, left or right of the flow (i.e. the lineal path) and, in a preferred embodiment, capable of both translating and skewing, depending on the amount of maximum curve desired, so as to position the saws within the saw cluster at the optimum angle of attack so as to follow the precise curvature of the cant or otherwise according to an optimized cutting solution, as the cant moves through the gangsaw in a fixed linear path. The saw blades are held perpendicular to the arbor by saw blade guides, which contact the sides of the saw blades to maintain the saw blades position in relation to the arbor as the cant is fed through the saw cluster, thus sawing the cant into boards utilizing the optimized profile. In summary, in a device for removing bulges, horns or flares on a cant, and in a device where a gangsaw has an in-feed mechanism for positioning a cant and feeding the cant generally longitudinally into the gangsaw along a feed path, wherein the cant is oriented with its planar faces generally horizontal, and wherein the in-feed mechanism has laterally opposed laterally translatable skewable chipping heads which may advantageously be of the disc-type laterally opposed on either side of the feed path, the method of the present invention for opening opposed generally vertical longitudinal faces so as to form curved longitudinal profiles on laterally opposed sides of the cant according to an optimized profile solution so as to feed the cant into the gangsaw along a generally linear feed path for curve sawing in the gangsaw includes the steps of (a) longitudinally translating and positioning the cant along the feed path between the chipping heads, (b) laterally translating and simultaneously skewing the chipping heads, according to the optimized profile solution, into cutting engagement with the laterally opposed sides of the cant so as to open the opposed generally vertical longitudinal faces and form the curved longitudinal profiles by aligning the plane of the chipping heads at an angle of attack so as to be generally parallel to the instantaneous tangent of the optimized profile solution at the instantaneous location of the cutting engagement of the chipping heads with the cant, (c) feeding the cant from between the chipping heads along a generally linear portion of the feedpath into the gangsaw. Advantageously, in combination with this method, the gangsaw may be actively translated and, in a preferred embodiment, also actively skewed according to an optimized curve sawing profile.

The method may further include the step of adjusting the angle of attack by a toe-in angle whereby the chipping heads slightly diverge in a downstream direction.

The method further may include the step of translating one or both of chipping heads away from the cant so as to partially disengage the cutting engagement for sensed bulges or horns in the cant whereby a risk of de-positioning of the cant by unequal chipping forces is reduced.

The method may further include the step of plunging one or both of the chipping heads into the cant so as to pre-buck slabs.

The method may be accomplished by a gangsaw in-feed mechanism for positioning a cant and feeding the cant generally longitudinally into a gangsaw along a feed path, wherein the cant is longitudinally translated and positioned through the gangsaw in-feed mechanism with the cant's planar faces generally horizontal, where the mechanism has laterally opposed laterally translatable skewable chipping heads lying generally in first and second generally parallel vertical planes laterally opposed on either side of the feed path for laterally translating and simultaneously skewing of the chipping heads, according to an optimized profile solution, into cutting engagement with the laterally opposed sides of the cant so as to open opposed generally vertical longitudinal faces and form opposed curved longitudinal profiles by aligning the chipping heads so as to align the first and second planes generally parallel to the instantaneous tangent of the optimized profile solution at an instantaneous location of the cutting engagement.

Advantageously, the chipping heads are adjusted to adjust the angle of attack by a toe-in angle so that the first and second planes slightly diverge in a downstream direction.

In one aspect of the invention, the optimized profile solution causes one or both of the chipping heads to be translated away from the cant so as to partially disengage the cutting engagement for sensed bulges or horns in the cant whereby a risk of de-positioning of the cant by unequal chipping forces is reduced.

Advantageously, said partial disengagement is symmetric on either side of the cant so as to equalize forces applied to the sides of the cant.

In one embodiment, the optimized profile solution may cause one or both of the chipping heads to be plunged into the cant so as to pre-buck slabs.

Advantageously, in the above method and device, the chipping heads are disc-type chipping heads.

In a preferred embodiment sensing means are provided between the chipping heads and the gangsaw so as to verify the actual position of the cant prior to the cant entering the gangsaw to allow adjustment of the active gangsaw in the event the cant has moved or shifted during chipping.

The invention provides other advantages which will be made clear in the description of the preferred embodiments.

BRIEF DESCRIPTION OF THE DRAWINGS

The invention will be better understood by reference to drawings, wherein.

DETAILED DESCRIPTION OF THE PREFERRED EMBODIMENT

Figure 1:
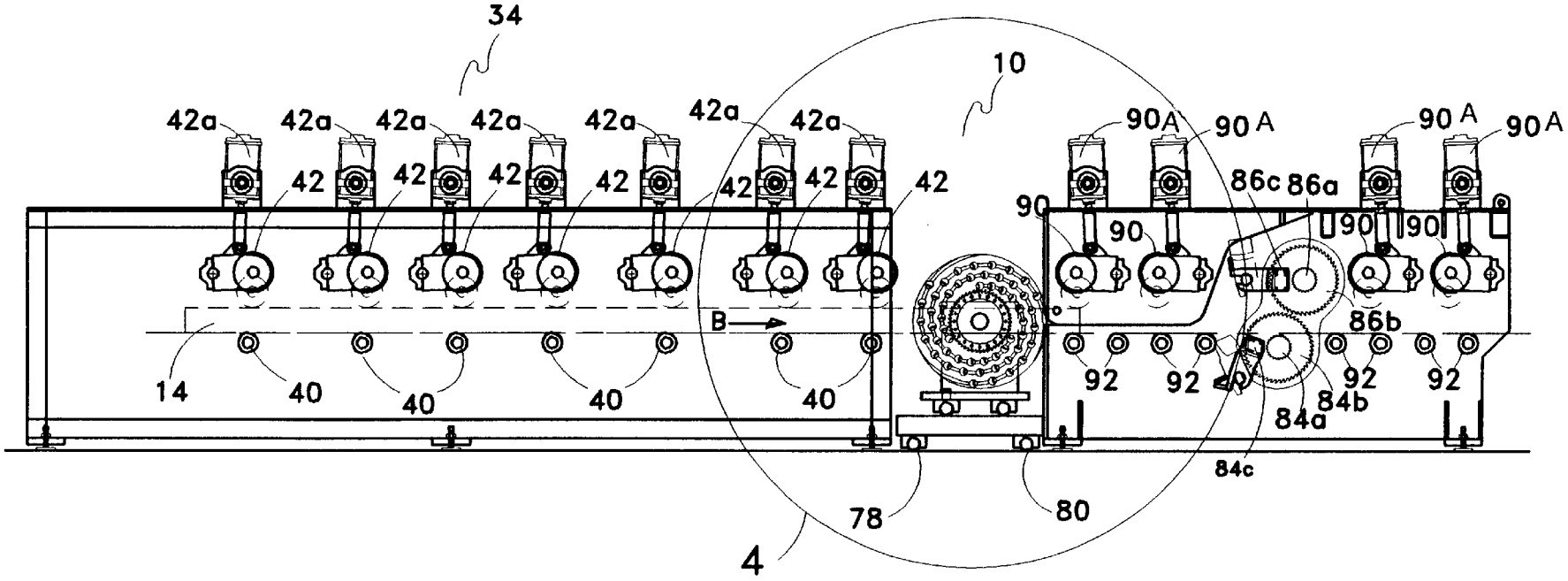
FIG. 1 is a side elevation section view according to a preferred embodiment of the invention, taken along section line 1—1 in FIG. 2.

Referring to the drawing figures wherein similar characters of reference represent corresponding parts in each view, the cant chipping apparatus is seen in FIGS. 1–4 and generally indicated by the reference numeral 10.

Figure 2:
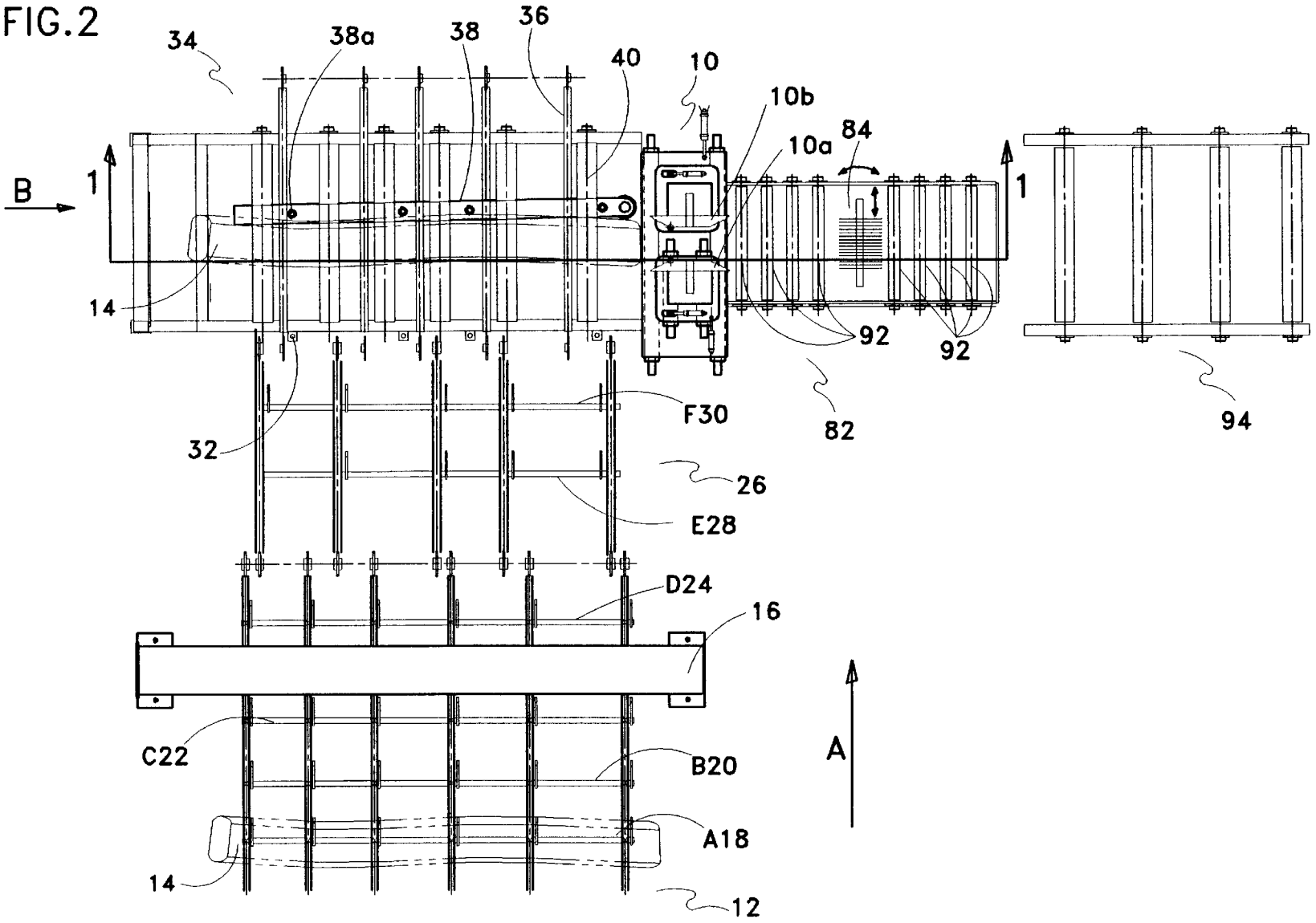
FIG. 2 is a plan view of the curve sawing system of the present invention.
Figure 5:
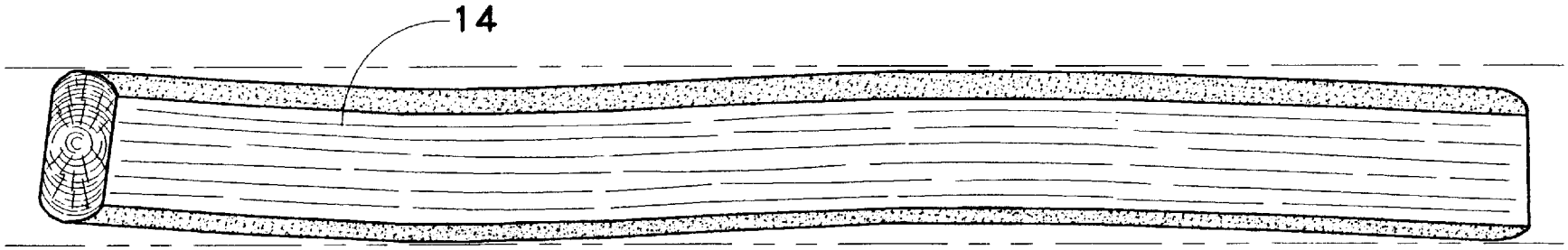
FIG. 5 is perspective view of a two sided curved cant.

As best seen in FIG. 2, a scanner indexing transfer 12 receives cant 14, better seen in FIG. 5, from the mill and begins to index cant 14 towards scanner 16 in direction A. Ducker A18 receives cant 14. When ducker B20 on the scanner indexing transfer 12 becomes available cant 14 is sequenced from ducker A18 to ducker B20. Cant 14 is sequenced from ducker B20 to ducker C22, when ducker C22 becomes available. Ducker C22 is mounted upstream of scanner 16.

When ducker D24 becomes available cant 14 is released by ducker C22, so that cant 14 is passed through scanner 16 and scanned. Cant 14 moves to ducker D24 on scanner indexing transfer 12. The cant is then transferred to a sequencing transfer 26. When ducker E28 on cant sequencing transfer 26 becomes available cant 14 is sequenced from ducker D24 to ducker E28. When ducker F30 on cant sequencing transfer 26 becomes available, cant 14 is sequenced from ducker E28 to ducker F30.

Positioning table 34 has park zone pins 32. When park zone pins 32 become available, cant 14 is sequenced from ducker F30 to park zone pins 32 on positioning table 34.

When positioning table 34 becomes available park zone pins 32 lower and a set of jump chains 36 are elevated from beneath table 34 and move cant 14 to skew bar pins 38*a* on skew bar 38 and thus onto positioning driven table rollers 40 (or other in-feed means). Jump chains 36 lower and a group of driven overhead pressrolls 42 actuated by means of pressroll cylinders 42*a*, press down so as to hold a constant pressure on cant 14 against table rollers 40. Skew bar pins 38*a* lower and driven table rollers 40 and driven overhead press rolls 42 feed cant 14 in direction B towards chipping head apparatus 10.

Chipping head apparatus 10 positions chipping head 10*a* and chipping head 10*b* in the correct starting position to accept the end of cant 14. Chipping head 10*a* is positioned by cylinder 44 for adjustment of thickness of cant 14, and cylinder 46 rotates chipping head 10*a* about pin 48 to adjust the angle of attack of the chipping head 10*a*. Chipping heads 10*a* and 10*b* are mounted on carriage 50. Cylinder 52 rotates chipping head 10*b* about pin 54 for adjustment of the angle of attack of chipping head 10*b*. Carriage 50 translated relative to cant 14, that is, perpendicular to the flow of cant 14 in direction B, by cylinder 56, so as to form the optimized curve on cant 14.

One end of cylinder 52 is attached to chipping head mount 58. The other end of cylinder 52 is attached to pin 60 mounted to carriage 50. One end of cylinder 46 is attached to chipping head mount 62. The other end of cylinder 46 is attached to pin 64. Pin 64 is mounted to sleeve 66. Sleeve 66 is slidably mounted on track 68. Track 68 is fixed to carriage 50. A second sleeve 70 is mounted to chipping head mount 62, which is slidably mounted on track 72. Track 72 is fixed to carriage 50.

Chipping head 10*a* is powered by and rotatably mounted on, chipping head driven bearing mount 62*a*. Chipping head 10*b* is powered by, and rotatably mounted on, chipping head driven bearing mount 58*a*. Carriage 50 is mounted on sleeves 74 and 76. Sleeves 74 and 76 are slidably mounted on tracks 78 and 80. Thus, cylinder 56 may be actuated to move carriage 50 perpendicular to the flow direction of cant 14.

Once chipping head apparatus 10 has been adjusted for thickness and for the starting position, and the angle of attack of chipping heads 10*a* and 10*b* has been adjusted for starting, power is applied to driven table rollers 40 and driven overhead press rolls 42 to feed cant 14 into chipping heads 10*a* and 10*b*. As cant 14 is fed through chipping head apparatus 10, chipping head apparatus 10 is constantly adjusted by cylinder 56 to follow the optimized curvature of cant 14. Simultaneously, chipping heads 10*a* and 10*b* are being angled by cylinders 46 and 52 to maintain the optimum angle of attack of chipping heads 10*a* and 10*b* in relation to the curvature of the cant as it is being fed through chipping heads 10*a* and 10*b*. It has been found that the optimum angle of attack aligns the plane of the chipping head so as to be generally parallel to the instantaneous tangent of the optimized profile solution at the location of the cutting engagement of the chipping head with the cant. Preferably, the angle of attack is adjusted to include a slight toe-in of the chipping head to prevent scuffing i.e. to prevent the downstream side of the chipping heads from being dragged across the downstream cant surfaces which would cause the planar face to be further cut or scuffed, making the surface concave. A toe-in angle $\alpha$ (seen in FIG. 3) of approximately 1° or 2° may prevent such scuffing.

Figure 3:
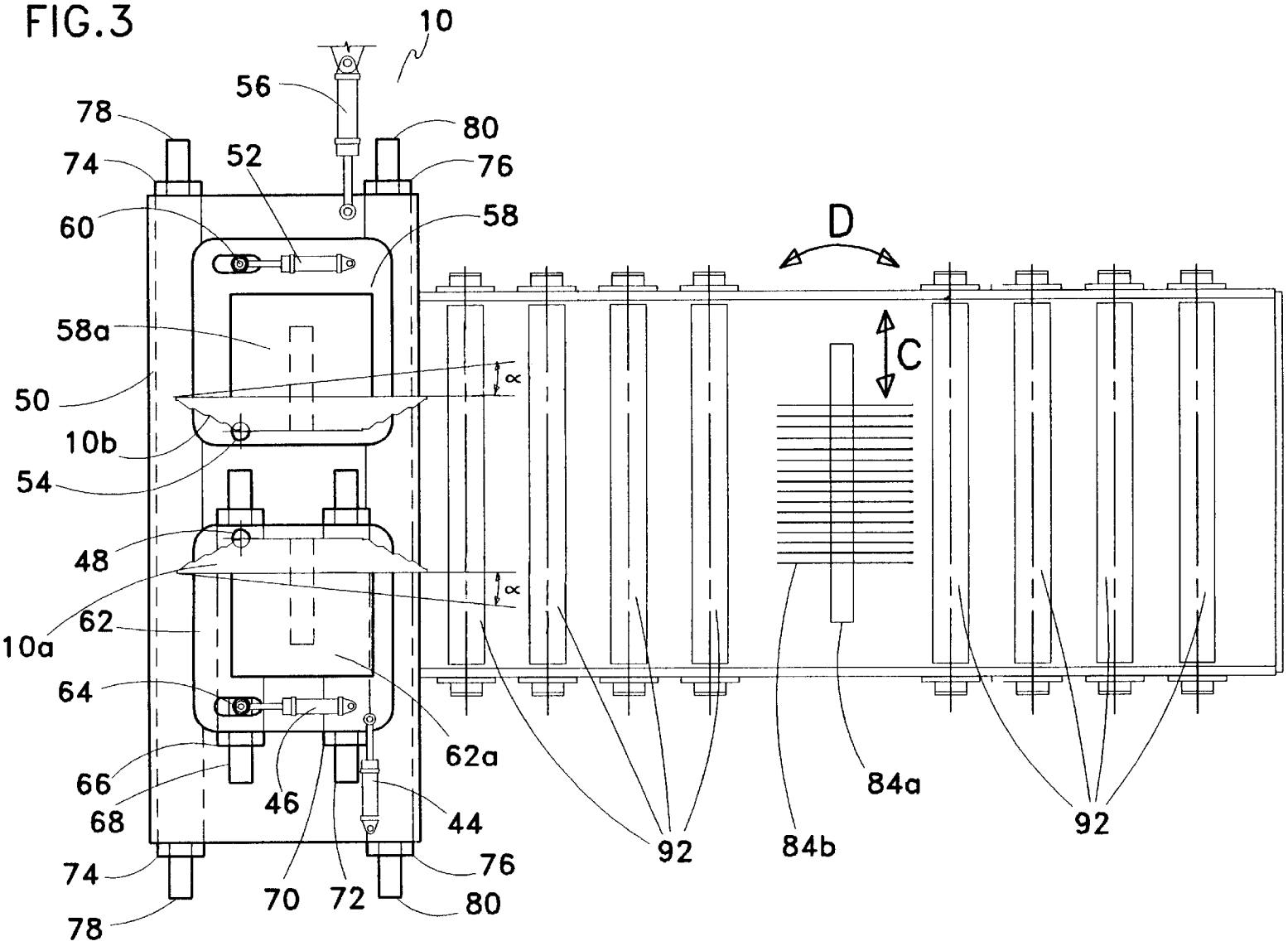
FIG. 3 is an enlarged view of FIG. 2.
Figure 4:
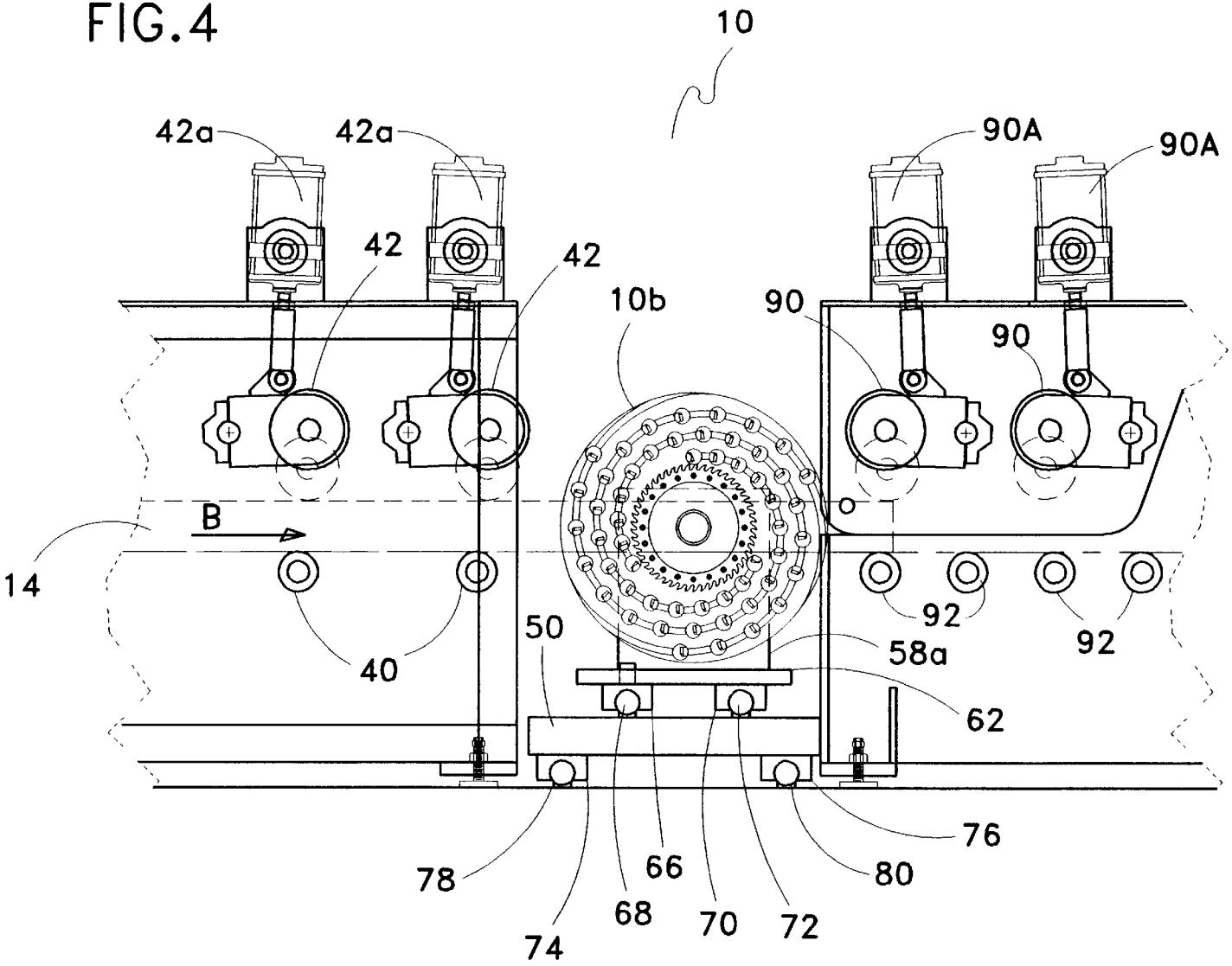
FIG. 4 is an enlarged section of the side elevation section view of FIG. 1.

The chipping head apparatus 10 translates laterally, that is, parallel to direction C, seen in FIG. 3, by actuation of cylinder 56 to form the optimized curve on cant 14, as cant 14 is fed through chipping heads 10*a* and 10*b*. As cant 14 moves into saw clusters 84 and 86 on gangsaw 82, (as best seen in FIG. 1), saw clusters 84 and 86 also move in direction C, delayed in time so as to match the form of cant 14 after it has been shaped by chipping heads 10*a* and 10*b*. Saw clusters 84 and 86 may also, in one embodiment, skew in direction D if the optimized curve-sawn curvature desired is too great given the machine constraints such as the diameter of saws 88 within saw clusters 84 and 86.

The saw blade clusters 84 and 86 are held by saw blade guides 84*c* and 86*c* fixed in relation to saw arbor 84*a* and 86*a* as saw blades 84*b* and 86*b* spin. Cant 14 is fed through gangsaw 82 by overhead driven pressrolls 90, actuated by press roll cylinders 90*a*, which press cant 14 onto driven lower bed rolls 92, whereby cant 14, now boards (not shown), is drawn through saw blade clusters 84 and 86 while maintaining a linear feed. Cant 14, now boards (not shown), are driven out of gangsaw 82 by driven press rolls 90, and onto gangsaw outfeed rollcase 94 for transfer downstream for further processing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. In a gangsaw in-feed mechanism for positioning a cant and feeding said cant generally longitudinally into a gangsaw along a feed path, wherein said cant is oriented with its planar faces generally horizontal, and wherein said in-feed mechanism comprises laterally opposed laterally translatable skewable chipping heads lying generally in first and second generally parallel vertical planes laterally opposed on either side of said feed path, a method for opening opposed generally vertical longitudinal faces so as to form curved longitudinal profiles on laterally opposed sides of said cant according to an optimized profile solution, so as to feed said cant into said gangsaw along a generally linear feed path for curve sawing in said gangsaw, comprising the steps of:

(a) longitudinally translating and positioning said cant along said feed path between said chipping heads, (b) laterally translating and simultaneously skewing said chipping heads, according to said optimized profile solution, into cutting engagement with said laterally opposed sides of said cant so as to open said opposed generally vertical longitudinal faces and form said curved longitudinal profiles by aligning said chipping heads so as to align said first and second planes at an angle of attack generally parallel to the instantaneous tangent of said optimized profile solution at an instantaneous location of said cutting engagement, (c) feeding said cant from between said chipping heads along a generally linear portion of said feedpath into said gangsaw.

2. The method of claim 1 further comprising the step of adjusting said angle of attack by a toe-in angle whereby said first and second planes slightly diverge in a downstream direction.

3. The method of claim 1 further comprising the step of translating one or both of said chipping heads away from said cant so as to partially disengage said cutting engagement for sensed bulges or horns in said cant whereby a risk of de-positioning of said cant by unequal chipping forces is reduced.

4. The method of claim 1 further comprising the steps of plunging one or both of said chipping heads into said cant so as to pre-buck slabs.

5. The method of claim 4 wherein said chipping heads are disc-type chipping heads.

6. A gangsaw in-feed mechanism for positioning a cant and feeding said cant generally longitudinally into a gangsaw along a feed path, wherein said cant is longitudinally translated and positioned through said gangsaw in-feed mechanism with said cant's planar faces generally horizontal, comprising laterally opposed laterally translatable skewable chipping heads lying generally in first and second generally parallel vertical planes laterally opposed on either side of said feed path for laterally translating and simultaneously skewing of said chipping heads, according to an optimized profile solution, into cutting engagement with said laterally opposed sides of said cant so as to open opposed generally vertical longitudinal faces and form opposed curved longitudinal profiles by aligning said chipping heads so as to align said first and second planes generally parallel to the instantaneous tangent of said optimized profile solution at an instantaneous location of said cutting engagement.

7. The device of claim 6 wherein said chipping heads are adjusted to adjust said angle of attack by a toe-in angle so that said first and second planes slightly diverge in a downstream direction.

8. The device of claim 1 wherein said optimized profile solution causes one or both of said chipping heads to be translated away from said cant so as to partially disengage said cutting engagement for sensed bulges or horns in said cant whereby a risk of de-positioning of said cant by unequal chipping forces is reduced.

9. The device of claim 1 wherein said optimized profile solution causes one or both of said chipping heads to be plunged into said cant so as to pre-buck slabs.

10. The device of claim 9 wherein said chipping heads are disc-type chipping heads.

11. In a gangsaw in-feed mechanism for positioning a cant and feeding said cant generally longitudinally into a gangsaw along a feed path, wherein said cant is oriented with its planar faces generally horizontal, and wherein said in-feed mechanism comprises laterally opposed laterally translatable skewable chipping heads lying generally in first and second generally parallel vertical planes laterally opposed on either side of said feed path, a method for opening opposed generally vertical longitudinal faces so as to form curved longitudinal profiles on laterally opposed sides of said cant according to an optimized profile solution, so as to feed said cant into said gangsaw along a generally linear feed path for curve sawing in said gangsaw, comprising the steps of:

(a) longitudinally translating and positioning said cant along said feed path between said chipping heads, (b) laterally translating and simultaneously skewing said chipping head, according to said optimized profile solution, into cutting engagement with said laterally opposed sides of said cant so as to open said opposed generally vertical longitudinal faces and form said curved longitudinal profiles by aligning said chipping heads so as to align said first and second planes at an angel of attack generally parallel to the instantaneous tangent of said optimized profile solution at an instantaneous location of said cutting engagement, (c) feeding said cant form between said chipping heads along a generally linear portion of said feedpath into said gangsaw, (d) in combination, at least translating and potentially also skewing said gangsaw according to an optimized cutting solution corresponding to said optimized profile solution.

12. The method of claim 1 further comprising the step of longitudinally translating and positioning said cant along said feed path, upstream of said chipping heads, between a second pair of active chipping heads for removing bulges, horns and flares from said cant.

13. The method of claim 11 further comprising the step of longitudinally translating and positioning said cant along said feed path, upstream of said chipping heads, between a second pair of active chipping heads for removing bulges, horns and flares from said cant.

* * * * *

UNITED STATES PATENT AND TRADEMARK OFFICE

CERTIFICATE OF CORRECTION

PATENT NO. : 5,816,302
DATED : October 6, 1998
INVENTOR(S) : William R. Newnes

It is certified that error appears in the above-identified patent and that said Letters Patent is hereby corrected as shown below:

Title page,
After Item "[22] Filed: Apr. 7, 1997", insert:
-- Related U.S. Application Data
[60] Provisional application No. 60/015,005, filed on Apr. 8, 1996 --

Signed and Sealed this

Twenty-ninth Day of April, 2003

JAMES E. ROGAN
*Director of the United States Patent and Trademark Office*